US009236675B2

(12) United States Patent
Tsuji et al.

(10) Patent No.: US 9,236,675 B2
(45) Date of Patent: Jan. 12, 2016

(54) TERMINAL FITTING

(71) Applicant: Sumitomo Wiring Systems, Ltd., Yokkaichi, Mie (JP)

(72) Inventors: Takeshi Tsuji, Yokkaichi (JP); Norihiko Tanigawa, Yokkaichi (JP); Yutaka Noro, Yokkaichi (JP); Shohei Mitsui, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 1 day.

(21) Appl. No.: 14/221,900

(22) Filed: Mar. 21, 2014

(65) Prior Publication Data

US 2014/0287635 A1 Sep. 25, 2014

(30) Foreign Application Priority Data

Mar. 21, 2013 (JP) ..... 2013-058746
Nov. 7, 2013 (JP) ..... 2013-231176

(51) Int. Cl.
*H01R 13/187* (2006.01)
*H01R 13/11* (2006.01)

(52) U.S. Cl.
CPC ..... *H01R 13/187* (2013.01); *H01R 13/113* (2013.01)

(58) Field of Classification Search
USPC ..... 439/852, 851, 841, 843, 845
See application file for complete search history.

(56) References Cited

U.S. PATENT DOCUMENTS

| | | | | | |
|---|---|---|---|---|---|
| 4,540,233 | A * | 9/1985 | Saijo et al. | ..... | 439/834 |
| 5,226,842 | A * | 7/1993 | Endo et al. | ..... | 439/843 |
| 5,271,741 | A * | 12/1993 | Saito et al. | ..... | 439/843 |
| 5,658,174 | A * | 8/1997 | Benes et al. | ..... | 439/843 |
| 5,702,272 | A * | 12/1997 | Machida | ..... | 439/843 |
| 5,810,627 | A * | 9/1998 | Gierut et al. | ..... | 439/843 |
| 6,062,918 | A * | 5/2000 | Myer et al. | ..... | 439/839 |
| 6,171,155 | B1 * | 1/2001 | Miwa et al. | ..... | 439/852 |
| 6,283,802 | B1 * | 9/2001 | Sato et al. | ..... | 439/843 |
| 6,325,679 | B2 * | 12/2001 | Sato et al. | ..... | 439/843 |
| 7,241,190 | B2 * | 7/2007 | Smyk | ..... | 439/852 |
| 7,294,027 | B1 * | 11/2007 | Tyler | ..... | 439/845 |
| 7,537,497 | B2 * | 5/2009 | Tyler | ..... | 439/843 |
| 7,556,541 | B2 * | 7/2009 | Tyler | ..... | 439/843 |

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A terminal fitting (10) includes a tubular connecting portion (11) into which a male tab (90) is to be inserted. A plate-shaped resiliently deflectable contact (14) is formed separately from the connecting portion (11) and extends in a front-back direction in the connecting portion (11) for contacting the male tab (90) inserted into the connecting portion (11). The connecting portion (11) includes locks (24) for locking the resilient contact (14) to the connecting portion (11). A support (42) as a deflection supporting point of the resilient contact (14) is provided on a rear end of the resilient contact portion (14). The support (42) is located behind the front ends of receiving portions (41) of the resilient contact (14) to be locked by the locks (24).

6 Claims, 19 Drawing Sheets

TERMINAL FITTING

BACKGROUND

1. Field of the Invention

The invention relates to a terminal fitting.

2. Description of the Related Art

U.S. Pat. No. 6,171,155 discloses a terminal fitting that has a tubular connecting portion with a front end. A plate-shaped resiliently deflectable contact is formed separately from the connecting portion and extends in a front-back direction in the connecting portion. A tab of a mating male terminal fitting is inserted into the connecting portion from the front and contacts the resilient contact to connect the terminal fittings electrically.

The connecting portion has a rear locking piece that is cut and bent from the bottom wall and shaped to lock the rear end part of the resilient contact portion from behind. Thus, a deflection support of the resilient contact is set before the rear locking piece.

The longitudinal length of a spring area of the resilient contact before the deflection support needs to be sufficiently long to exhibit a satisfactory springiness and to ensure smooth connection to the male tab. However, a demand for miniaturization limits the length of the terminal fitting. The rear locking piece is behind the deflection support. Thus, the length of the connecting portion is at least the sum of the longitudinal lengths of the spring area and the rear locking piece of the resilient contact. As a result, the above-described terminal fitting cannot easily meet the demand for miniaturization.

The invention was completed based on the above situation and aims to provide a terminal fitting capable of meeting a request for miniaturization and satisfactorily exhibiting the springiness of a resilient contact.

SUMMARY OF THE INVENTION

The invention relates to a terminal fitting with a tubular connecting portion. A plate-shaped resiliently deflectable contact is formed separately from the connecting portion and extends in a front-back direction in the connecting portion. A mating male tab can be inserted into the connecting portion from the front and resiliently contacts the contact. The connecting portion includes a lock that is locked to the resilient contact. A deflection supporting point of the resilient contact is on one of the front and rear end parts of the resilient contact; and a part of the resilient contact to be locked by the lock is at a position overlapping an area extending from the supporting point to the other of the front and rear end parts of the resilient contact in the front-back direction. Thus, the lock is within the range of the longitudinal length of the spring area of the resilient contact, and the longitudinal length of the spring area of the resilient contact is not increased by the lock. As a result, the resilient contact can exhibit satisfactory springiness even if the longitudinal length of the connecting portion is shortened with the miniaturization of the terminal fitting.

The resilient contact preferably includes a contact main body extending in the front-back direction and two receiving portions protruding toward opposite outer sides from one of front and rear end parts of the contact main body. The receiving portions are the parts to be locked by the lock. The supporting point is provided on the one of the front and rear end parts of the contact main body. Two slits are provided in the resilient contact between the contact main body and the receiving portions and open toward the other of the front and rear end parts from positions on the side of the supporting point in the front-back direction. The slits ensure a sufficient longitudinal length of the spring area of the resilient contact. Further, the slits prevent a locking force of the lock to be transmitted to the supporting point of the contact main body and a deflection supporting function of the supporting point is exhibited without difficulty. Furthermore, coupling margins of the contact main body and the receiving portions can be ensured by adjusting the lengths of the slits, so that the desired resiliency of the resilient contact can be achieved.

The receiving portions are fixed by caulking to the connecting portion by the locking portion and may be thinner than other parts of the resilient contact portion. Caulking the receiving portions to the connecting portion could shift the receiving portions toward the contact main body, thereby narrowing the slits, and could cause the supporting point to deform sufficiently to impede smooth deformation of the contact main body. However, the receiving portions are thinner than the other parts of the resilient contact. Thus, the supporting point is not deformed and the contact main body deflects smoothly.

The supporting point may be on the rear end part of the resilient contact and may be behind the front end of the part to be locked by the lock. Thus, a large holding force can be obtained between the resilient contact portion and the male tab when the male tab is inserted into the connecting portion.

The supporting point may be on the front end part of the resilient contact portion and may be before the rear end of the part to be locked by the lock. Thus, insertion resistance of the male tab into the connecting portion can be suppressed.

DETAILED DESCRIPTION OF THE PREFERRED EMBODIMENTS

Figure 12:
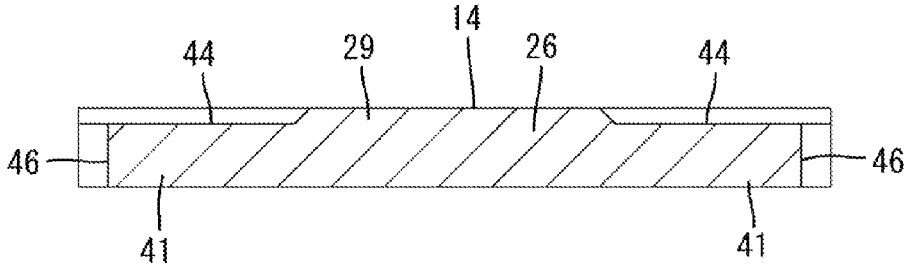
FIG. 12 is a section of a part of the resilient contact corresponding to both receiving portions.
Figure 13:
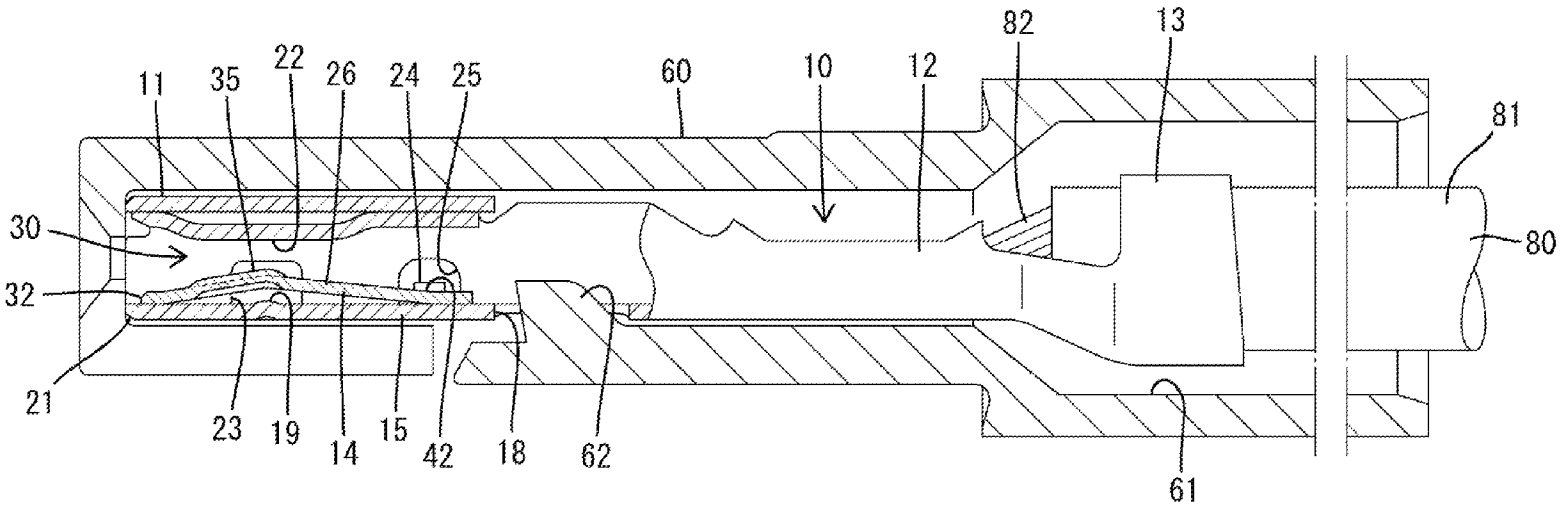
FIG. 13 is a side view partly in section of the terminal fitting inserted into a cavity of a connector housing.
Figure 14:
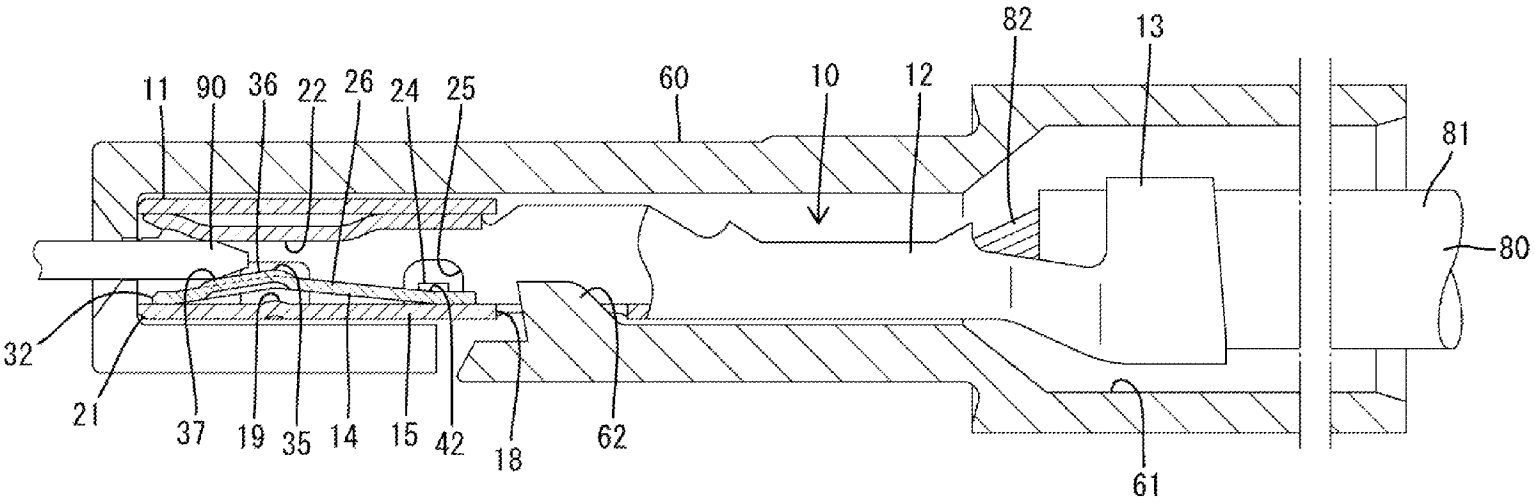
FIG. 14 is a side view partly in section of the terminal fitting with a mating male tab is inserted in the connecting portion.
Figure 15:
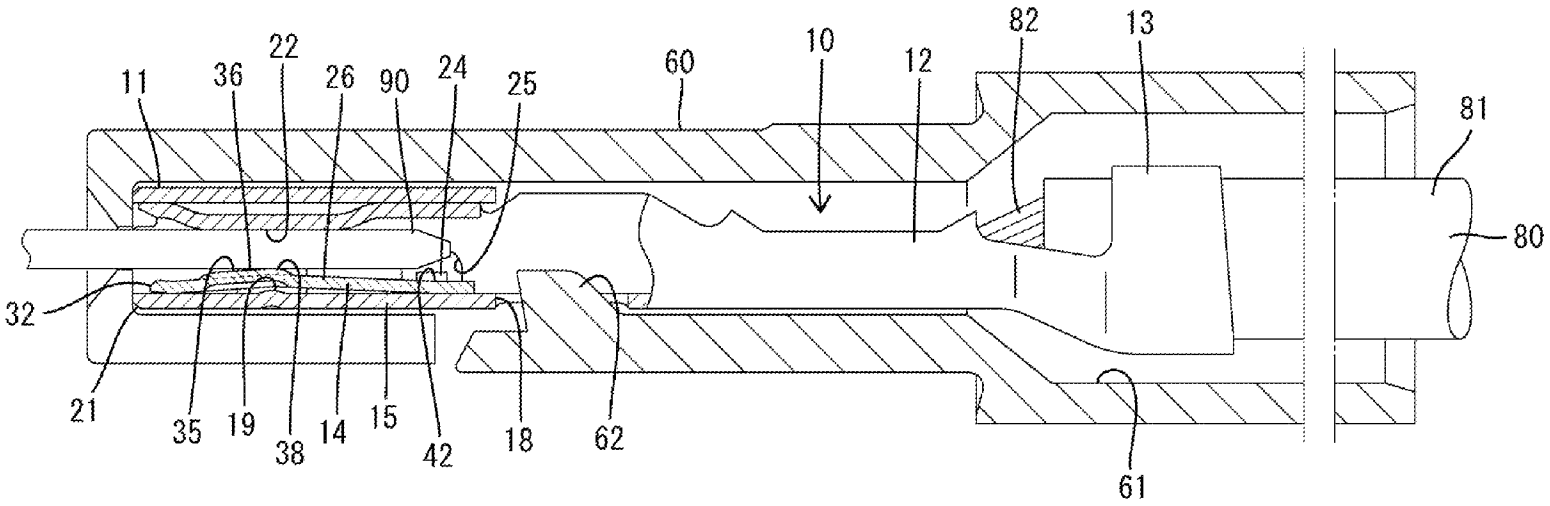
FIG. 15 is a side view partly in section of the terminal fitting with the male tab properly inserted in the connecting portion.

A first embodiment of the invention is described with reference to FIGS. 1 to 16. A terminal fitting 10 of this embodiment is made of an electrically conductive metal plate material and is long and is narrow in a front-back direction. As shown in FIG. 13, the terminal fitting 10 is inserted into a cavity 61 of a connector housing 60 and is connected electrically to a male tab 90 of a mating connector, as shown in FIG. 15, as the housing 60 is connected to an unillustrated housing of the mating connector.

Figure 1:
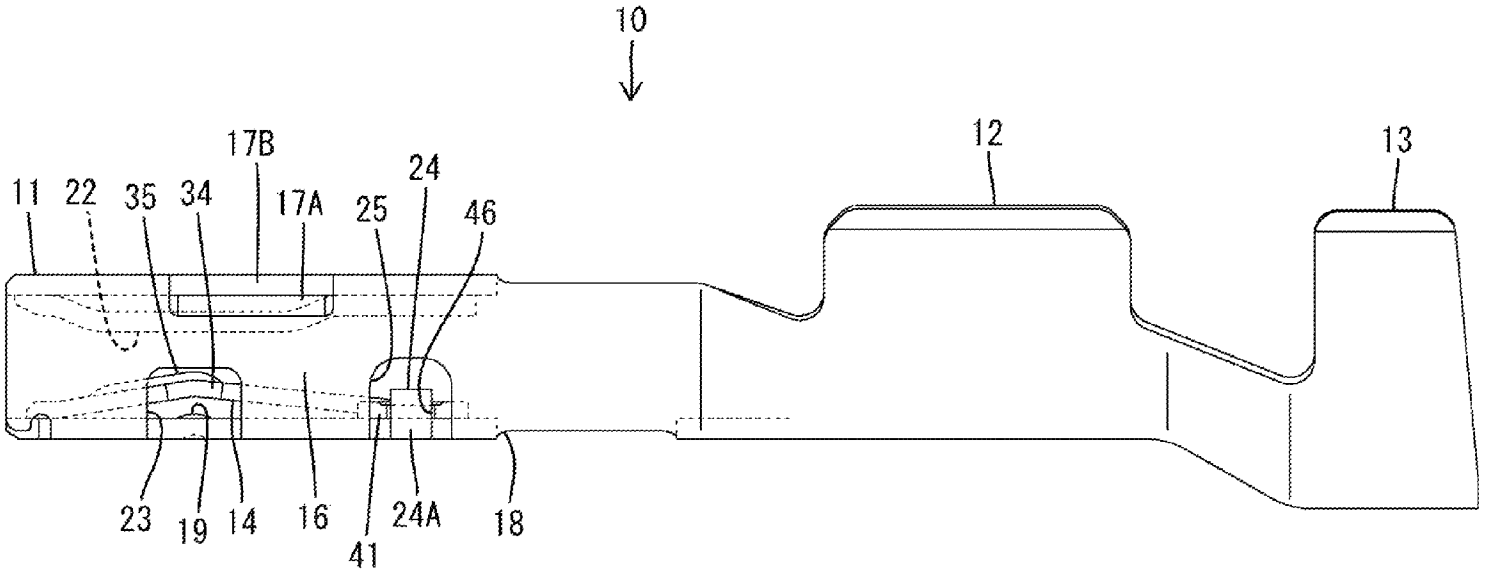
FIG. 1 is a side view of a terminal fitting of a first embodiment of the invention.
Figure 2:
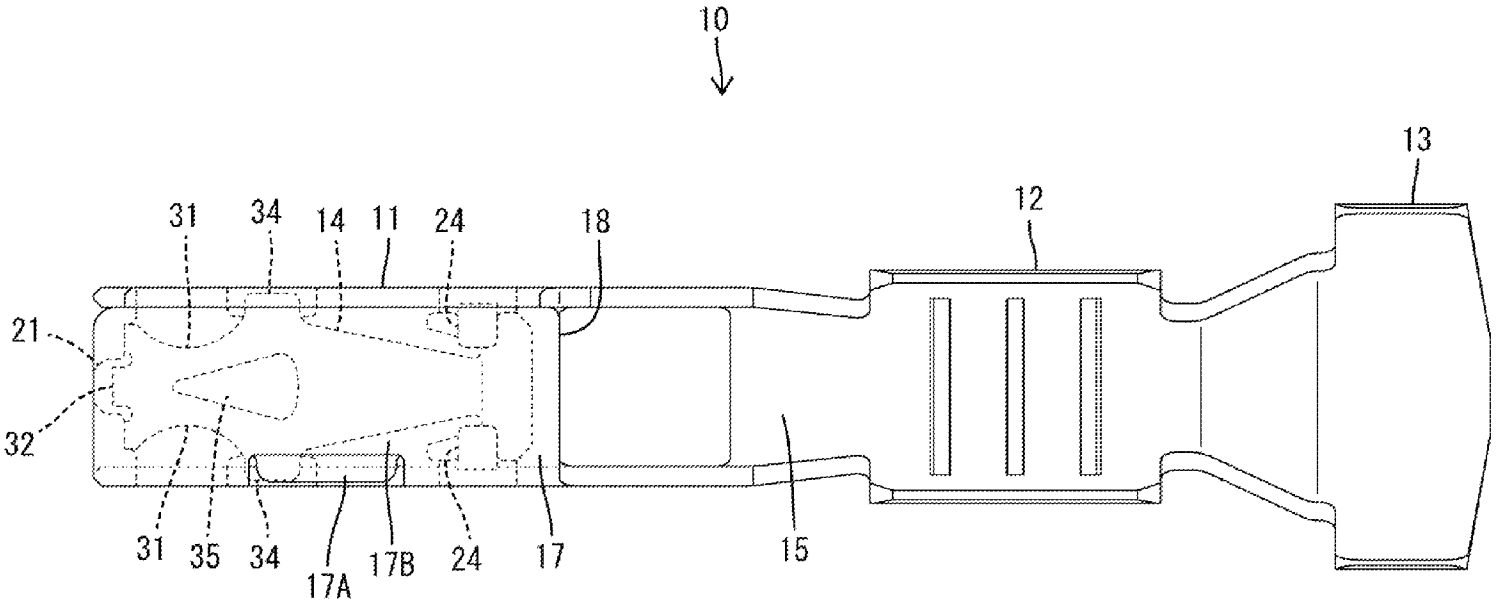
FIG. 2 is a plan view of the terminal fitting.
Figure 3:
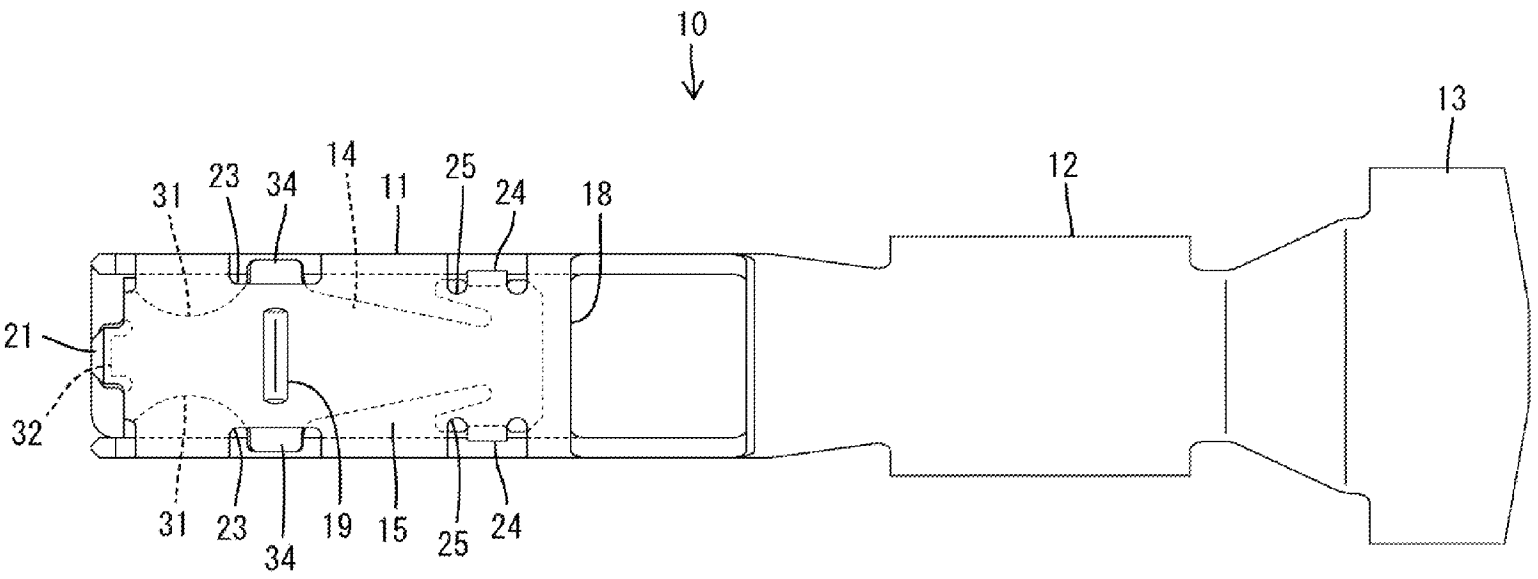
FIG. 3 is a bottom view of the terminal fitting.

The terminal fitting 10 is shown in FIGS. 1 to 3 and includes a tubular connecting portion 11, a wire barrel 12 behind the connecting portion 11 and an insulation barrel 13 behind the wire barrel 12. A resilient contact 14 in the form of a plate is provided separately from the connecting portion 11 and is arranged in the connecting portion 11. The resilient contact 14 is made of copper alloy with high springiness and is formed of a material different from the connecting portion 11, which is made of brass.

As shown in FIG. 13, the wire barrel 12 is crimped and connected to a core 82 exposed by removing insulation coating 81 at an end of a wire 80 and the insulation barrel 13 is crimped and connected to the insulation coating 81 at the end part of the wire 80.

Figure 4:
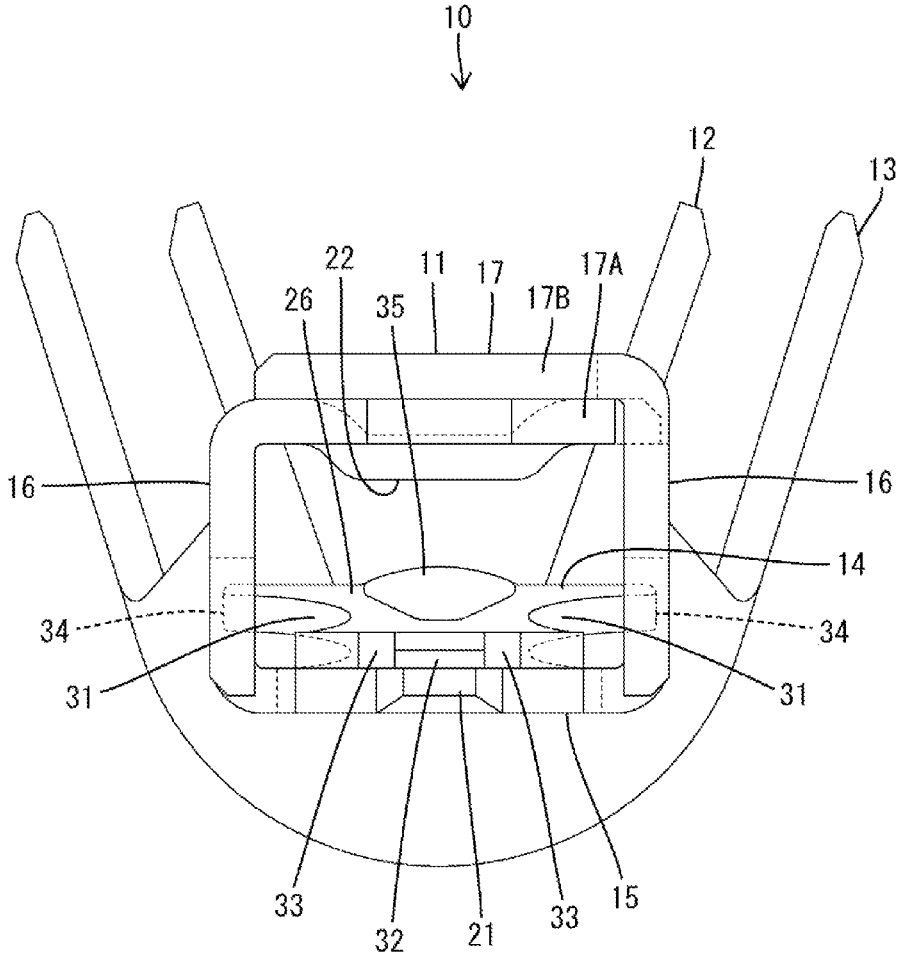
FIG. 4 is a front view of the terminal fitting.

The connecting portion 11 is a long narrow rectangular tube extending in the front-back direction and includes, as shown in FIG. 4, a base wall 15 extending along a width direction, two side walls 16 erected from opposite sides of the base wall 15 and a facing wall 17 extending between upper ends of the side walls 16. As shown in FIG. 3, the base wall 15 extends over the entire length of the terminal fitting 10 and also defines bottom parts of the wire barrel 12 and the insulation barrel 13. A rectangular lance hole 18 is formed in the base wall 15 between the connecting portion 11 and the wire barrel 12. As shown in FIG. 13, when the terminal fitting 10 is inserted properly into the cavity 61, a tip of a locking lance 62 projecting from the inner wall of the cavity 61 is fit resiliently into the lance hole 18 of the base wall 15 and retains the terminal fitting 10 in the cavity 61.

Figure 5:
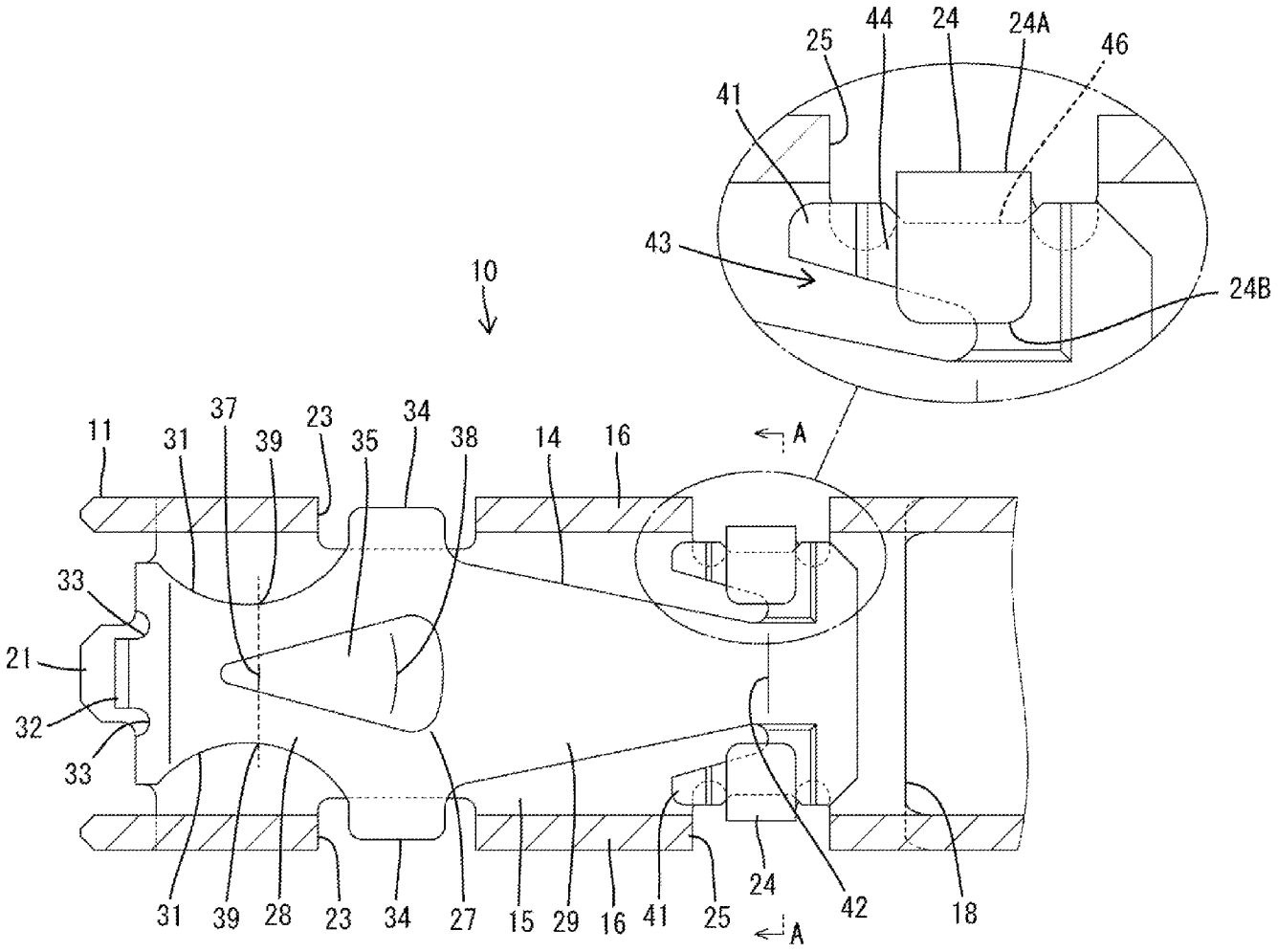
FIG. 5 is a cross-sectional view showing the interior of a connecting portion.
Figure 7:
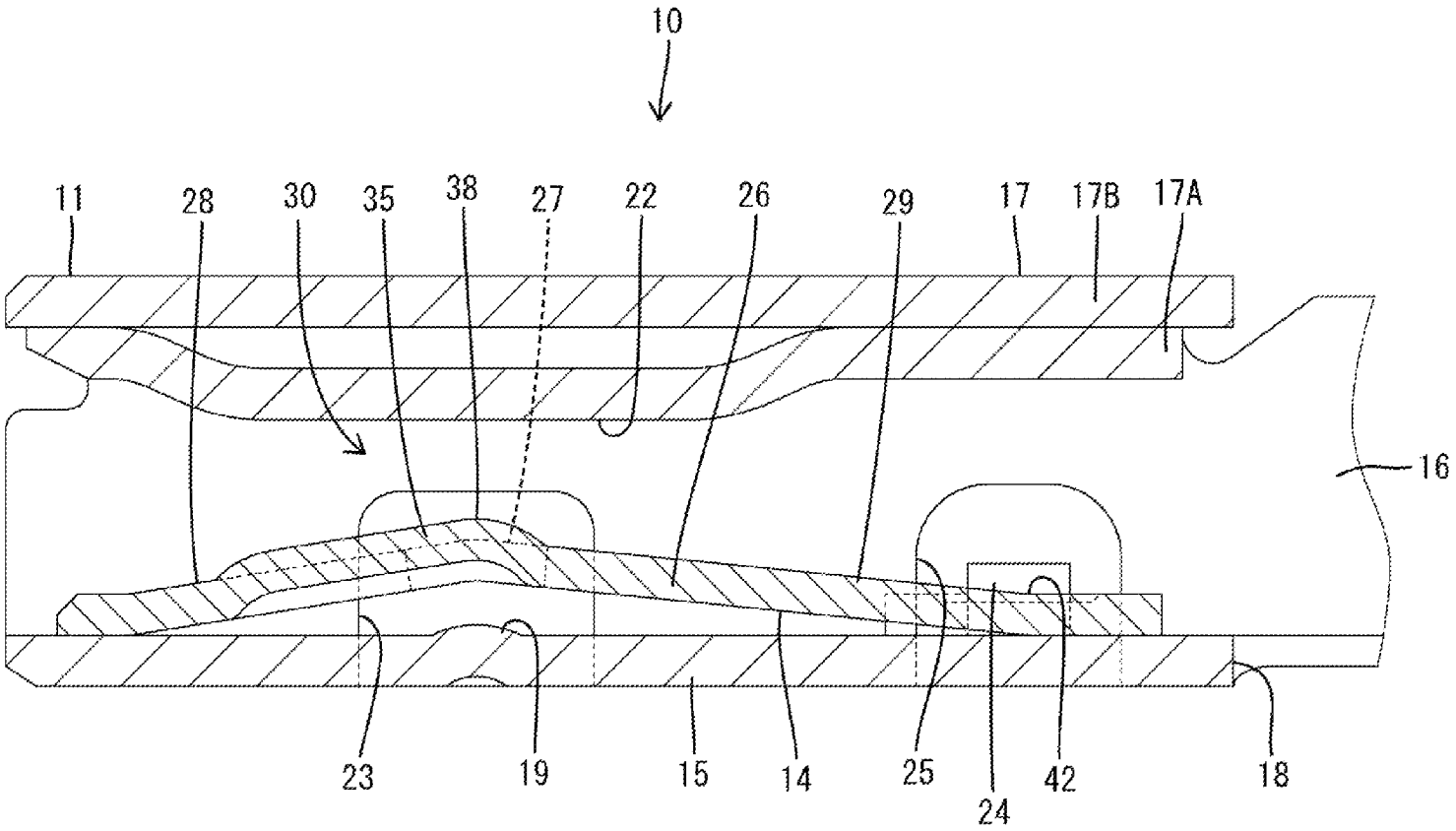
FIG. 7 is a side view in section showing the interior of the connecting portion.
Figure 8:
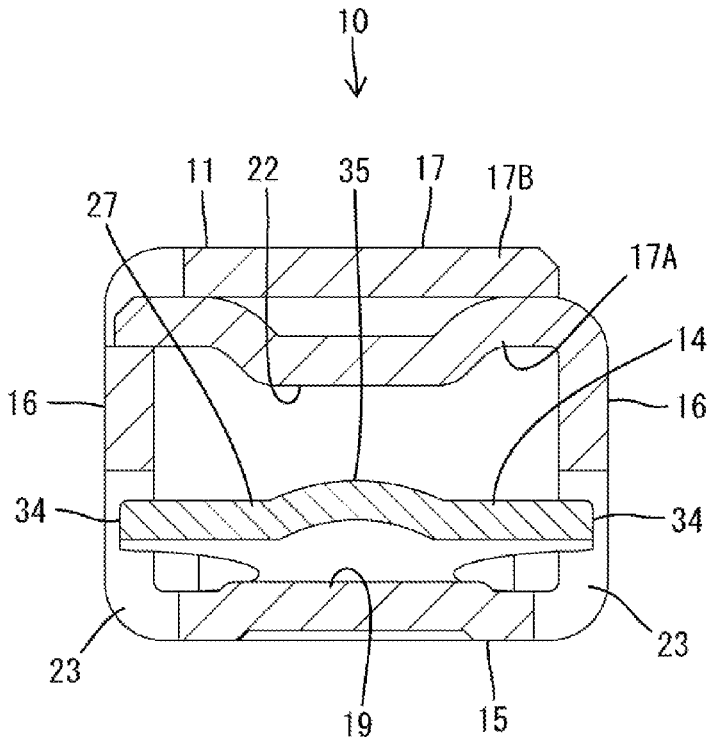
FIG. 8 is a front view in section showing the interior of the connecting portion.

As shown in FIG. 7, an excessive deflection preventing portion 19 projects into the connecting portion 11 on a part of the base wall 15 facing the resilient contact 14. As shown in FIG. 8, the excessive deflection preventing portion 19 is a rib extending along the width direction and formed by striking the base wall 15 up. The resilient contact 14 contacts the excessive deflection preventing portion 19 to prevent excessive deflection and deformation. Further, as shown in FIGS. 3 and 5, a projecting piece 21 projects forward in a widthwise central part of the front end of the base wall 15. The front end of the projecting piece 21 is at substantially the same position as the front ends of the side walls 16 and the facing wall 17.

As shown in FIG. 8, the facing wall 17 is composed of a lower wall 17A extending from the upper end of one side wall 16 to a locked engagement with an upper part of the other side wall 16 and an upper wall 17B extending from the upper end of the other side wall 16 toward the upper end of the one side wall 16 while being placed on the upper surface of the lower wall 17A. As shown in FIG. 7, the lower wall 17A is formed with a tab receiving portion 22 that projects into the connecting portion 11 at a position facing the resilient contact 14. The tab receiving portion 22 is a rib extending in the front-back direction and formed by striking the lower wall 17A down.

As shown in FIGS. 1 and 8, confirmation windows 23 are formed on lower parts of the side walls 16 and receive confirmation pieces 34 of the resilient contact 14. The confirmation windows 23 are open from the side walls 16 to the base wall 15 and the confirmation pieces 34 can be confirmed visually from lateral and lower sides through the confirmation windows 23 as shown in FIGS. 1 and 3.

Figure 6:
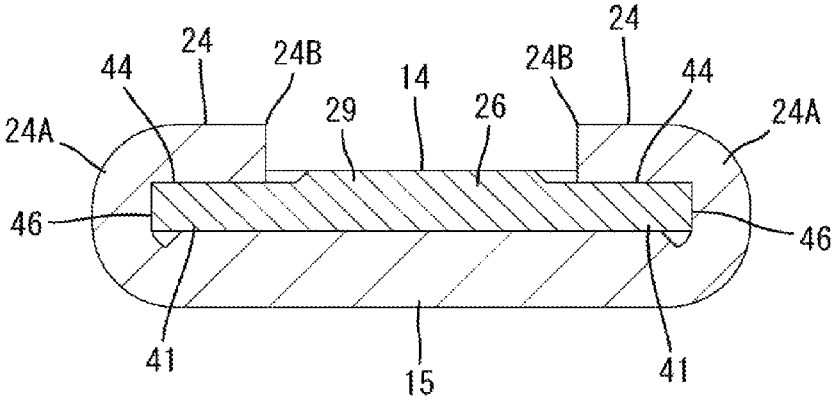
FIG. 6 is a section along A-A of FIG. 5.
Figure 16:
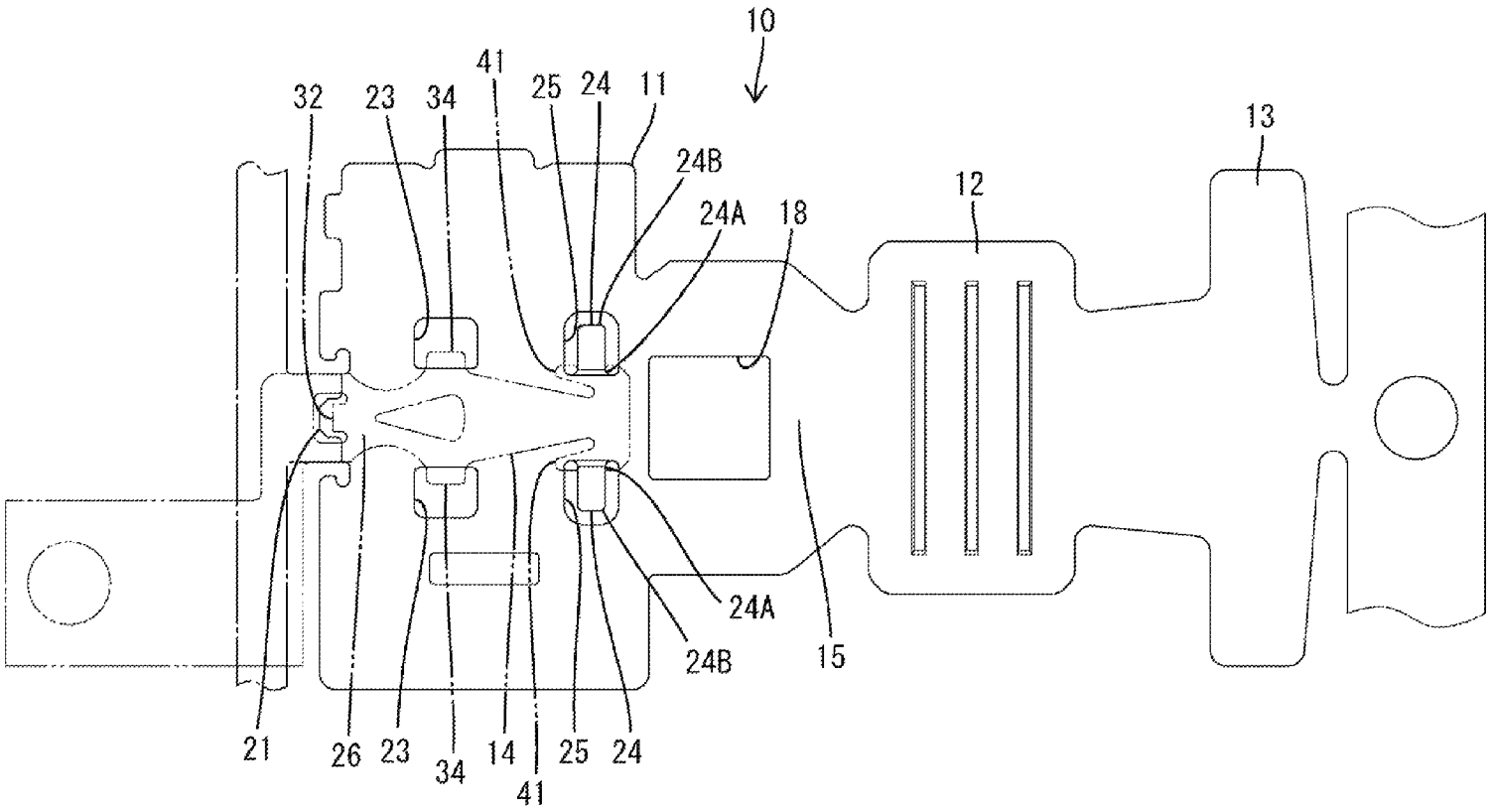
FIG. 16 is a plan view of the blank for forming the terminal fitting.

As shown in FIGS. 1 and 5, locks 24 are provided on the lower parts of the side walls 16 behind the confirmation windows 23. The locks 24 are cut and erected from holes 25 that are open from the side walls 16 to the base wall 15 and are bent and deformed into the interior of the connecting portion 11 to be placed in close contact with receiving portions 41 of the resilient contact 14 from above. Specifically, as shown in FIG. 16, in a development state, each lock 24 is cantilevered laterally out from a base end 24A to a tip 24B. The base end 24A is on the base wall 15 and the tip 24B is on the side wall 16. As shown in FIG. 6, in a bent state, the locks 24 are folded toward the base wall 15B and the receiving portions 41 of the resilient contact 14 are sandwiched vertically (thickness direction of the resilient contact 14) between the tips 24B and the base wall 15. Further, the locks 24 are arranged so that the upper surfaces are lowered from the upper surface of the base wall 15 at the base ends 24A (see FIG. 16), and have a smaller thickness than other parts of the connecting portion 11 including the base wall 15.

Figure 9:
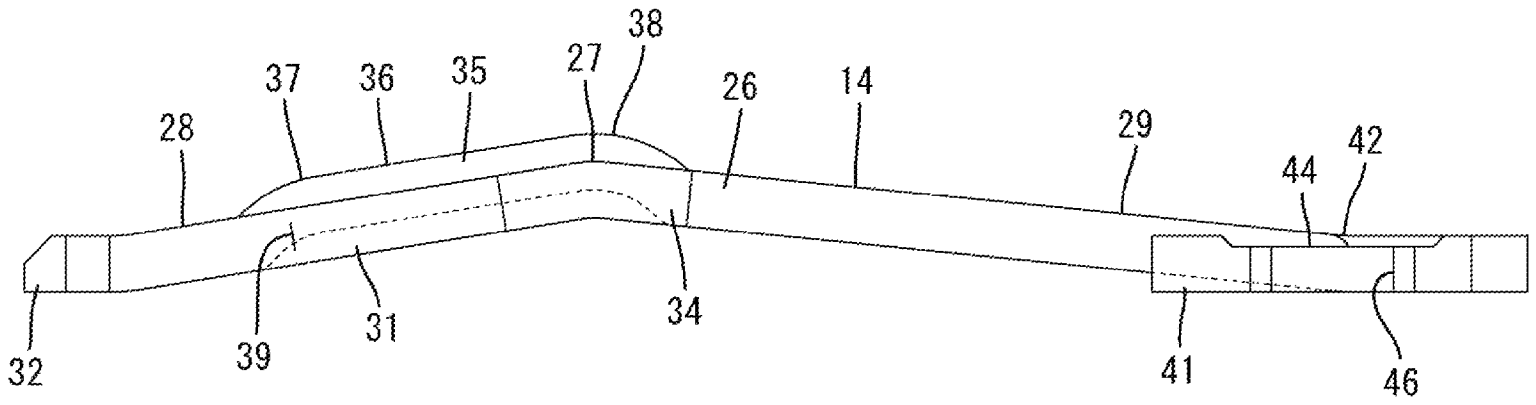
FIG. 9 is a side view of a resilient contact.

The resilient contact 14 includes a contact main body 26 extending in the front-back direction and having an angled side view bent at an intermediate position in the extending direction, as shown in FIG. 9. The contact main body 26 includes an apex 27, a front portion 28 inclined down to the front from the apex 27 and a rear portion 29 inclined down to the back from the apex 27. When the resilient contact 14 is mounted in the connecting portion 11, the apex 27 is closest to the tab receiving portion 22 to form an insertion space 30 for the male tab 89 between the apex 27 and the tab receiving portion 22, as shown in FIG. 7. Additionally, the front end of the front portion 28 is in contact with the projecting piece 21 of the base wall 15 and the rear end of the rear portion 29 is arranged in contact with a position of the base wall 15 before the lance hole 18, as shown in FIG. 5.

Figure 11:
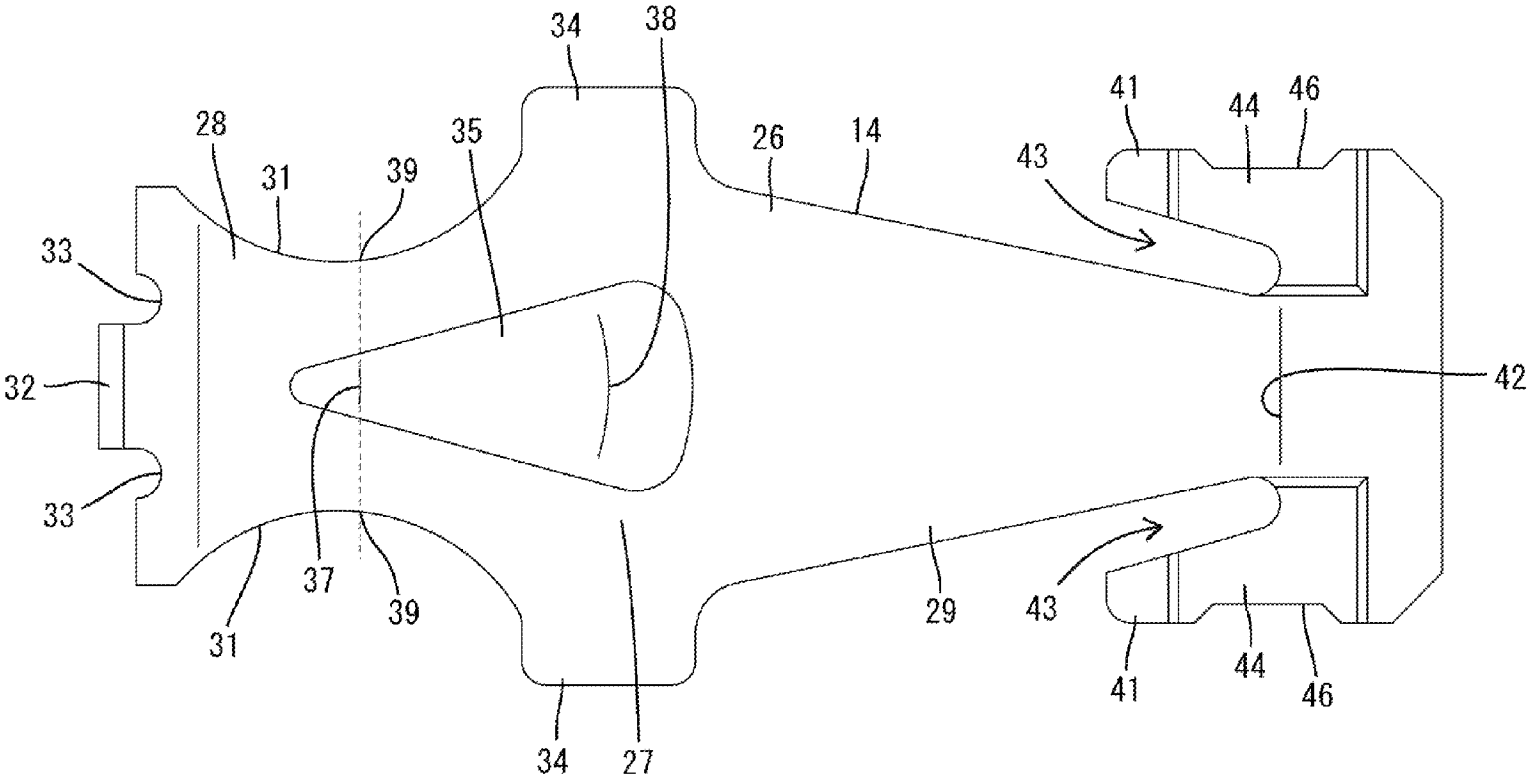
FIG. 11 is a plan view of the resilient contact.

As shown in FIG. 11, two arcuate curved portions 31 are recessed toward the widthwise center of the contact main body 26 at opposite lateral edges of the front portion 28 in the plate width direction so that the contact main body 26 is constricted toward a widthwise center of the contact main body 26 in a plan view. The front end of the front portion 28 is widened before the curved portions 31 and includes a contact piece 32 projecting forward in a widthwise central part. The contact piece 32 is slidable on the projecting piece 21 of the base wall 15 (see FIG. 5) while being held in contact with the projecting piece 21. Further, the upper surface of the contact piece 32 is pressed to thin the contact piece 32. Two cuts 33 are formed on opposite widthwise sides of the contact piece 32 on the front end of the front portion 28.

As shown in FIG. 11, the apex 27 of the contact main body 26 is wider than the front and rear portions 28 and 29, and confirmation pieces 34 are project toward opposite widthwise outer sides. Each confirmation piece 34 has a substantially rectangular plan view, and is in one of the confirmation windows 23 for visual confirmation when the resilient contact 14 is mounted in the connecting portion 11. The confirmation pieces 34 are in a lifted state without being held in contact with the opening edges of the confirmation windows 23, as shown in FIG. 1.

Figure 10:
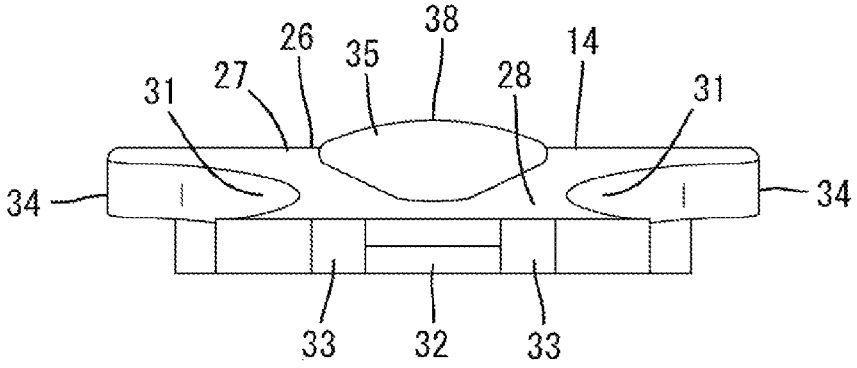
FIG. 10 is a front view of the resilient contact.

A widthwise central part of the apex 27 of the contact main body 26 is struck up to form an embossed contact 35, as shown in FIGS. 9 and 10. The embossed contact 35 extends from the apex 27 to the front portion 28 and has a gradually reduced width from the rear of the apex 27 toward the front portion 28, as shown in FIG. 11. A straight edge 36 having a straight side view is formed on the upper surface of the embossed contact 35, as shown in FIG. 9, and has substantially the same angle of inclination as the front portion 28.

A contact start position 37 is at the front of the straight edge 36 of the embossed contact 35 (see FIG. 14) and makes the first contact with the male tab 90 inserted into the connecting portion 11. A contact end position 38 is on a rear part of the straight edge 36 of the embossed contact 35 and contacts the male tab 90 that has been inserted completely into the connecting portion 11 (see FIG. 15). As shown in FIG. 11, the contact start position 37 of the embossed contact 35 is side by side with most recessed parts 39 of the curved portions 31 and hence is at the narrowest part of the front portion 28 of the contact main body 26. The contact end position 38 of the embossed contact 35 is behind the rear ends of the curved portions 31 and is arranged coaxially side by side with the confirmation pieces 34 in the width direction. Further, as shown in FIG. 7, the contact end position 38 is the uppermost part of the embossed contact 35 and is closest to the tab receiving portion 22 when the resilient contact 14 is mounted in the connecting portion 11.

As shown in FIG. 11, the rear portion 29 of the contact 26 gradually narrows from the apex 27 toward the back and is unitary with the receiving portions 41 on a rear part thereof. The receiving portions 41 protrude laterally out from opposite lateral edges of the rear end of the rear portion 29 so that the receiving portions 41 are at opposite widthwise sides of the rear portion 29 of the contact main body 26. Further, a support 42 extends along the width direction at a position immediately before a part of the rear portion 29 of the contact main body 26 coupled to the receiving portions 41. The resilient contact portion 14 is vertically resiliently deflectable with the supporting 42 as a fixed end.

The receiving portions 41 protrude laterally from the rear portion 29 of the contact main body 26 and then project forward, as shown in FIG. 11. Forwardly open slits 43 are formed between the opposite lateral edges of the contact main body 26 and the forward projecting parts of the receiving portions 41. The slits 43 extend obliquely out and forward in the front-back direction and are spaced farther from each other toward the front. Rear ends of the slits 43 are at substantially the same position as the support 42 in the front-back direction. In other words, the support 42 is arranged substantially on a straight line connecting rear ends of the slits 43.

The receiving portions 41 gradually widened from the front ends toward the back in reverse proportion to the rear portion 29 of the contact main body 26 gradually narrowing toward the back. As shown in FIGS. 11 and 12, a crimping surface 44 is formed on the upper surface of each receiving portion 41 and is held by one of the locks 24. The crimping surfaces 44 are lowered slightly from the upper surfaces of opposite front and rear sides of the receiving portions 41 by a press. Thus, the receiving portions 41 are thinned at the crimping surfaces 44. Further, as shown in FIG. 11, the crimping surfaces 44 extend farther back than the slits 43 while facing the slits 43 at inner sides and intersect with opposite widthwise ends of the support 42 at an intermediate position in the front-back direction. As shown in FIG. 6, the locks 24 closely contact the crimping surfaces 44 of the receiving portions 41, so that the receiving portions 41 are fixed by caulking to the connecting portion 11 and are sandwiched between the locks 24 and the base wall 15.

Outer lateral edges of the receiving portions 41 corresponding to the crimping surfaces 44 are recessed to form cuts 46, as shown in FIG. 11. The base end portions 24A of the locks 24 fit in the cuts 46 when the receiving portions 41 are fixed by caulking by the locks 24, thereby fixing the locks 24 in the front-back direction.

The resilient contact 14 is placed on the base wall 15 of the connecting portion 11 in a development state (see FIG. 16). More particularly, the locks 24 are placed in close contact with the crimping surfaces 44 of the receiving portions 41 of the resilient contact 14 by a press. As a result, the receiving portions 41 are fixed by caulking and are sandwiched between the locks 24 and the base wall 15 (see FIGS. 5 and 6). The slits 43 are between the receiving portions 41 and the contact main body 26. Additionally, the receiving portions 41 and the locks 24 are thinned. Thus, a caulking force received from the locks 24 by the receiving portions 41 does not affect the support 42 significantly and the support 42 does not deform.

Subsequently, in the development state, parts of the base wall 15 protruding toward opposite widthwise outer sides are successively bent to define the side walls 16 and the facing wall 17 and to form the connecting portion 11. Then, as shown in FIG. 13, the terminal fitting 10 is inserted into the cavity 61 of the connector housing 60 in a state connected to the end part of the wire 80, and held and retained by the locking lance 62.

The housing 60 is connected to the unillustrated mating housing so that the mating male tab 90 is inserted into the connecting portion 11 of the terminal fitting 10 from the front. As shown in FIG. 14, the male tab 90 first contacts the connection start position 37 of the embossed contact 35 and the contact main body 26 accordingly is deflected and deformed about the support 42. The embossed contact 35 is displaced down as the contact main body 26 is deflected and the contact piece 32 slides forward on the projecting piece 21. The support 42 is located behind the front ends of the receiving portions 41 and the entire longitudinal length of the contact main body 26 is ensured to be sufficiently long so that the contact main body 26 exhibits satisfactory springiness. Further, the part of the contact main body 26 corresponding to the connection start position 37 of the contact portion 35 is narrowed by the curved portions 31. Thus, resistance received by the male tab 90 at the connection start position 37 is reduced and insertion feeling is improved.

The male tab 90 is inserted to a proper depth in the connecting portion 11 when the housing 60 is connected properly to the mating housing. Thus, the male tab 90 is sandwiched resiliently between the connection end position 38 of the embossed contact 35 and the tab receiving portion 22, as shown in FIG. 15. The connection end position 38 of the embossed contact 35 at the apex 27 of the contact main body 26 is widened due to the protruding confirmation pieces 34. Therefore, the male tab 90 contacts the embossed contact 35 with proper contact pressure at the connection end position 38.

The connection start position 37 of the embossed contact 35 is aligned with the most recessed parts 39 of the curved portions 31. Thus, an inserting force of the male tab 90 is reduced significantly and insertion feeling is improved. On the other hand, the connection end position 38 of the embossed contact 35 is not aligned with the curved portions 31 and good contact pressure of the male tab 90 is ensured when connection is complete.

The rear portion 29 of the contact main body 26 gradually narrows toward the back and the support 42 is at the narrowest part. Thus, the insertion force of the male tab 90 is reduced and the insertion feeling is improved. Furthermore, the gradually narrowing of the rear portion 29 of the contact main body 26 toward the back forms empty spaces at opposite widthwise sides of the rear part of the rear portion 29 and the receiving portions 41 are arranged in these empty spaces. Therefore space efficiency is improved. Further, the widths of the rear ends of the receiving portions 41 can be increased in accordance with the narrow support 42 so that large crimping surfaces 44 to be locked by the locks 24 can be ensured. As a result, the resilient contact portion 14 is fixed stably to the connecting portion 11 via the receiving portions 41.

The support 42 is behind the front ends of the receiving portions 41 and the locks 24 are arranged within the range of the longitudinal length of a spring area of the resilient contact 14. Thus, the spring area of the resilient contact portion 14 is sufficiently long. As a result, the resilient contact 14 exhibits satisfactory springiness even if the connecting portion 11 is shortened with the miniaturization of the terminal fitting 10.

The support 42 is between the rear ends of the slits 43 on the rear part of the contact main body 26. Thus, the length of the spring area of the contact main body 26 is ensured to be even longer by the depth of the slits 43 and the springiness of the resilient contact portion 14 is improved further.

The receiving portions 41 are thinner than the other parts of the resilient contact 14. Thus, a caulking force exerted by the locks 24 on the receiving portions 41 is less likely to be transmitted to the supports 42 and the support 42 will not deform. As a result, the contact main body 26 deforms smoothly.

The confirmation windows 23 of the connecting portion 11 enable visual confirmation the confirmation pieces 34 of the resilient contact 14 from lateral and lower sides to confirm proper positioning of the resilient contact 14 in the connecting portion 11.

Figure 17:
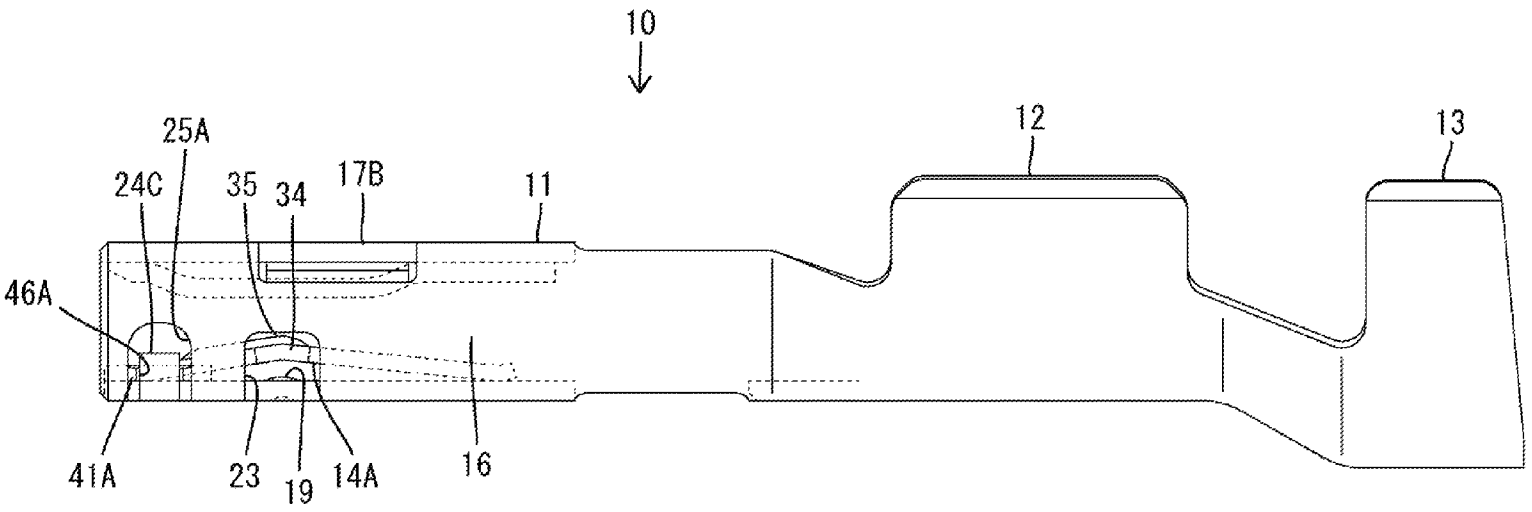
FIG. 17 is a side view of a terminal fitting of a second embodiment.
Figure 18:
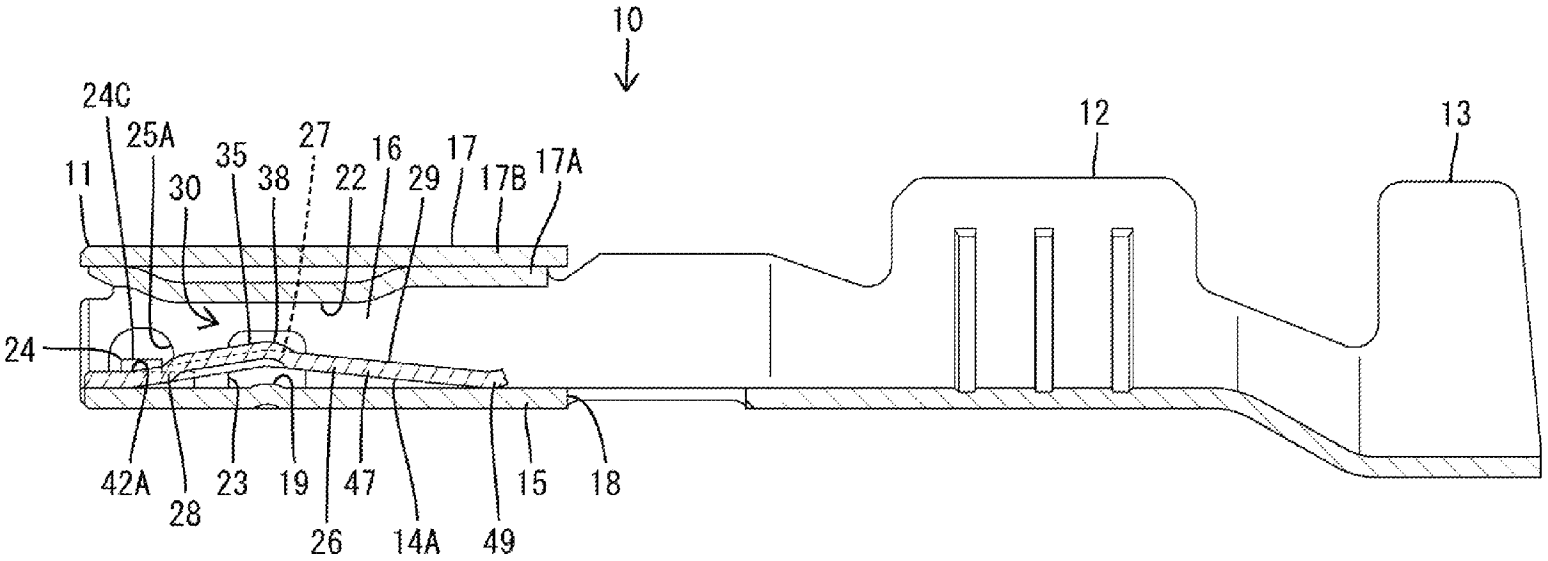
FIG. 18 is a side view in section of the terminal fitting.
Figure 19:
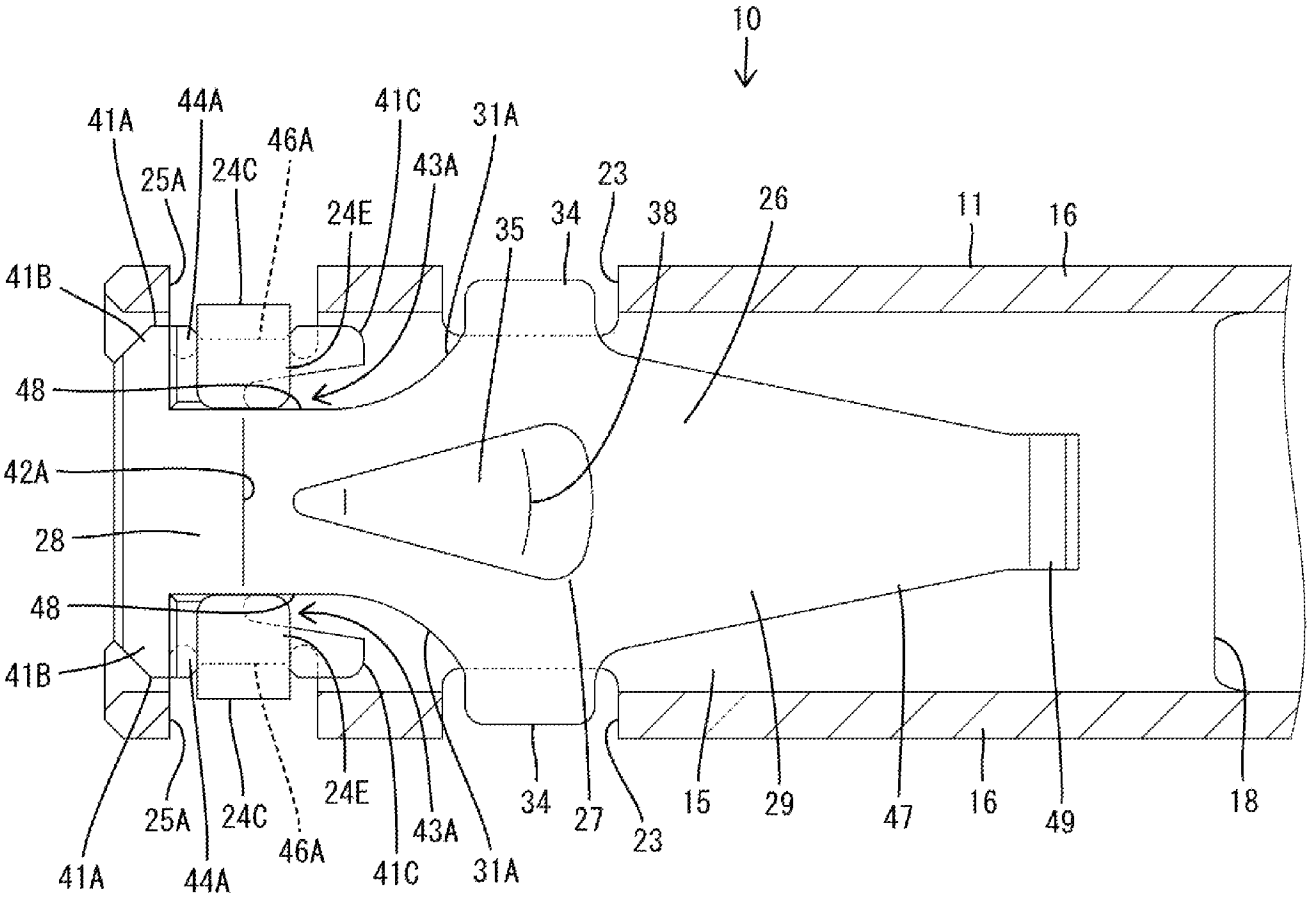
FIG. 19 is a plan view in section of the interior of a connecting portion.

FIGS. 17 to 19 show a second embodiment of the invention. The second embodiment differs from the first embodiment in that a resilient contact 14A is cantilevered back from a front end. A support 42A and receiving portions 41A are provided on a front part of the resilient contact 14A and locks 24C are provided on a front part of a connecting portion 11. Other parts of the second embodiment are similar to the first embodiment and are not described again.

As shown in FIG. 19, two locks 24C are provided before both confirmation windows 23 on lower end sides of both side walls 16 of the connecting portion 11. As in the first embodiment, the locks 24C are cut and erected from holes 25A that are open from the side walls 16 to a base wall 15 and are bent and deformed into the interior of the connecting portion 11. Tips 24E are held in close contact with crimping surfaces 44A of the receiving portions 41A of the resilient contact portion 14A. The receiving portions 41A of the resilient contact 14A are caulked by the locking portions 24C and sandwiched between the tips 24E of the locking portions 24C and the base wall 15.

As shown in FIG. 19, two receiving portions 41A are provided on a front portion 28 of a contact main body 26 of the resilient contact 14A. Couplings 41B protrude toward opposite lateral sides from a front end of the front portion 28 and projecting portions 41C project back from the couplings 41B. Slits 43A are provided between the projecting portions 41C of the receiving portions 41A and the opposite lateral edges of the front portion 28 of the contact main body 26. Opposite lateral edges of the front portion 28 of the contact main body 26 include curved portions 31A extending forward in a curved manner from both confirmation pieces 34 and straight portions 48 extending straight forward from the front ends of the curved portions 31A. The coupling portions 41B of the receiving portions 41A are unitary with the straight portions 48.

The crimping surfaces 44A of the receiving portions 41A are provided over the entire widths of the couplings 41B and the projecting portions 41C except on front end parts of the couplings 41B. The receiving portions 41A are thinner in parts corresponding to the crimping surfaces 44A. Further, as in the first embodiment, the outer lateral edges of the receiving portions 41A are recessed in parts corresponding to the crimping surfaces 44A to form cuts 46A. When being caulked to the receiving portions 41A, the locks 24C are fit the cuts 46A and the resilient contact 14A is fixed with respect to the locking portions 24C in the front-back direction.

As shown in FIG. 19, a support 42A extending straight in the width direction is provided substantially at the same position as the front ends of the slits 43A and rear ends of the couplings 41B in the front-back direction on the front end of the front portion 28 of the contact main body 26. As in the first embodiment, the support 42A is arranged within the formation range of the receiving portions 41A and the locks 24C for locking the receiving portions 41A in the front-back direction.

As shown in FIG. 18, the front portion 28 of the contact main body 26 is inclined up from the support 42A to an apex 27. Further, as shown in FIGS. 18 and 19, a rear portion 29 of the contact main body 26 includes a main rear portion 47 inclined down toward the back from the apex 27, gradually narrowed and inclined at a constant angle of inclination toward the back from the confirmation pieces 34. A tip rear portion 49 extends with a constant width from the main rear portion 47 to the rear end and bends somewhat up. The tip rear portion 49 is in contact with the upper surface of the base wall 15.

Here, when being inserted into the connecting portion 11 from front, a male tab 90 comes into contact with an embossed contact 35 of the resilient contact 14A and the resilient contact portion 14A deflects down about the support 42A. At this time, the tip rear portion 49 of the resilient contact 14A moves back while sliding on the upper surface of the base wall 15. Thus a force of the resilient contact 14A acting on the male tab 90 does not become excessive and an increase in insertion resistance of the male tab 90 is suppressed.

The invention is not limited to the above described and illustrated embodiments. For example, the following modes are also included in the technical scope of the present invention.

The curved portion may be formed only on one lateral edge of the contact main body.

The contact start position of the embossed contact need not align precisely with the most recessed parts of the curved portions in the width direction and has only to be approximately at a position between recessed parts of the curved portions.

One lock may be provided on the connecting portion and only one receiving portion may be provided on the resilient contact.

The support of the first embodiment may be behind the rear ends of the receiving portions. Further, the support of the second embodiment may be before the front ends of the receiving portions. In short, the receiving portions merely have to overlap the spring area (area from the support to the end part of the resilient contact opposite to the support) of the resilient contact in the front-back direction.

The confirmation pieces may be configured to contact the opening edges of the confirmation windows when the resilient contact is in a natural or a deflected state.

The insulation barrel may be crimped and connected to a rubber plug mounted on the insulation coating of the end part of the wire.

What is claimed is:

1. A terminal fitting, comprising:

a tubular connecting portion into which a mating male tab is to be inserted; and a plate-shaped resilient contact formed separately from the connecting portion, the resilient contact having opposite first and second end parts spaced apart in a front-back direction and being disposed in the connecting portion for resiliently contacting the male tab inserted into the connecting portion, wherein:

the connecting portion includes at least one lock for locking the resilient contact to the connecting portion;

a support provided on the second end part of the resilient contact and supporting the resilient contact in the connecting portion; and the resilient contact having a part locked by the lock and provided at a position overlapping an area extending from the support to the second end part of the resilient contact in the front-back direction, the resilient contact further having a contact main body extending in the front-back direction and two receiving portions protruding toward opposite outer sides from the second end part of the contact main body, the receiving portions include the part of the resilient contact locked by the lock.

2. The terminal fitting of claim 1, further comprising two slits formed in the resilient contact between the contact main body and the receiving portions and extending from positions on sides of the support toward the first end part in the front-back direction.

3. The terminal fitting of claim 1, wherein the locks are caulked into engagement with receiving portions to fix the resilient contact to the connecting portion by the lock and formed to be thinner than other parts of the resilient contact.

4. The terminal fitting of claim 3, wherein the receiving portions are thinner than other parts of the resilient contact.

5. The terminal fitting of claim 1, wherein the support is located on a rear end part of the resilient contact and is behind a front end of the part to be locked by the lock.

6. The terminal fitting of claim 1, wherein the support is located on a front end part of the resilient contact and is before a rear end of the part to be locked by the lock.

* * * * *